US005499725A

United States Patent [19]

Palumbo

[11] Patent Number: 5,499,725

[45] Date of Patent: Mar. 19, 1996

[54] REMOVABLE BATH ACCESSORY BAR

[76] Inventor: Dominick P. Palumbo, 88 Lyman Ave., N. Patchogue, N.Y. 11772

[21] Appl. No.: 288,483

[22] Filed: Aug. 10, 1994

[51] Int. Cl.[6] ..... A47F 5/00

[52] U.S. Cl. ..... 211/105.1; 211/86

[58] Field of Search ..... 211/86, 105.1, 211/123, 100

[56] References Cited

U.S. PATENT DOCUMENTS

| | | | |
|---|---|---|---|
| 2,639,816 | 5/1953 | Fogg | 211/86 |
| 3,019,909 | 2/1962 | Churchill | 211/86 |
| 3,163,295 | 12/1964 | Standard | 211/86 |
| 3,471,031 | 10/1969 | Coplan | 211/100 X |
| 4,087,006 | 5/1978 | Schill | 211/86 |
| 4,103,781 | 8/1978 | Sterling | 211/86 |
| 4,488,651 | 12/1984 | Bishop | 211/105.6 |
| 4,760,929 | 8/1988 | Fedorchak | 211/105.1 X |

*Primary Examiner*—Robert W. Gibson, Jr.
*Attorney, Agent, or Firm*—Galgano & Burke

[57] ABSTRACT

The present invention relates to a removable bar for hanging bath accessories located traversally across and above a bathing area which is configured to generally span the width of a bathing area. The invention includes an elongated support bar horizontally suspended between a shower curtain or door support and an opposite wall of the bathing area. The support bar has a hook-like hanger attached to a first end which suspends the support bar atop the shower curtain or door support and an opposite second end with a resilient cushion which wedges the support bar against the opposite wall of the bathing area. Support pegs which project outwardly from the support bar provide a means for hanging bathing accessories from the support bar.

1 Claim, 2 Drawing Sheets

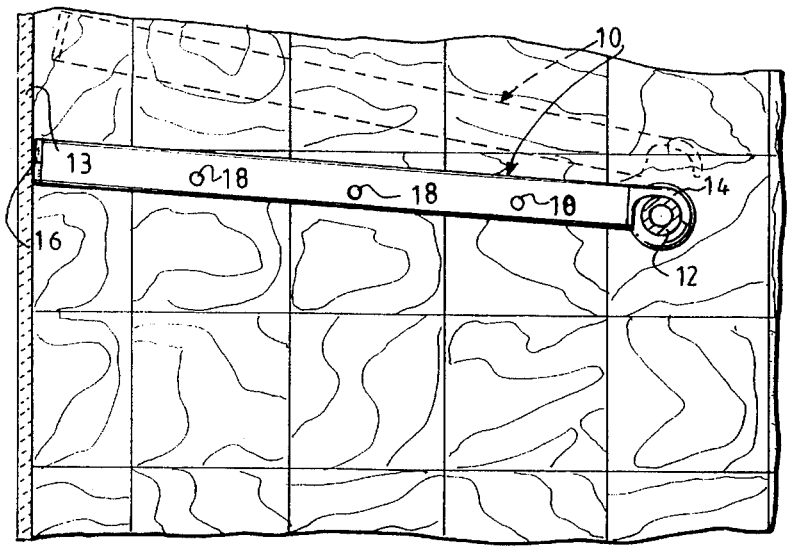
Fig. 3
Fig. 4
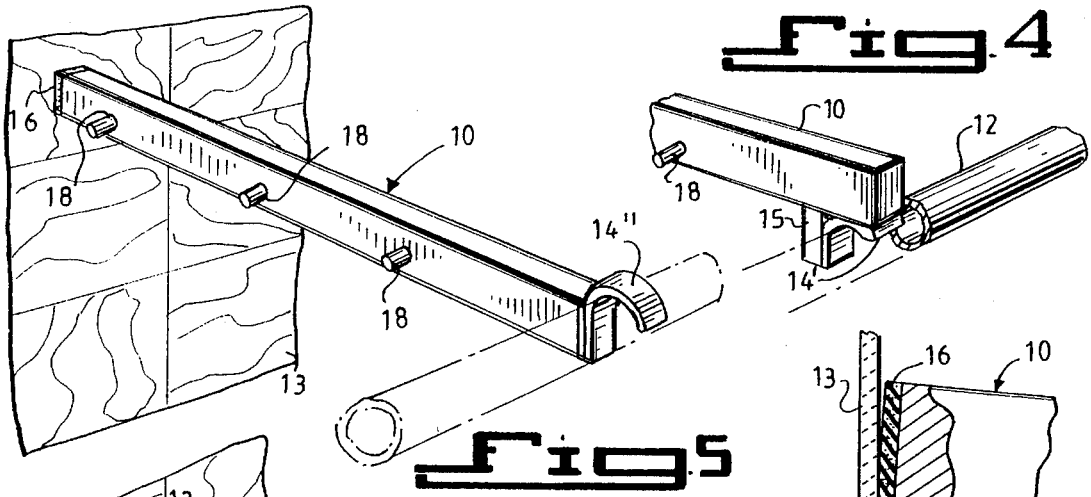
Fig. 5
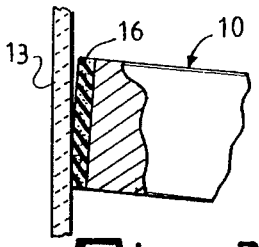
Fig. 3a
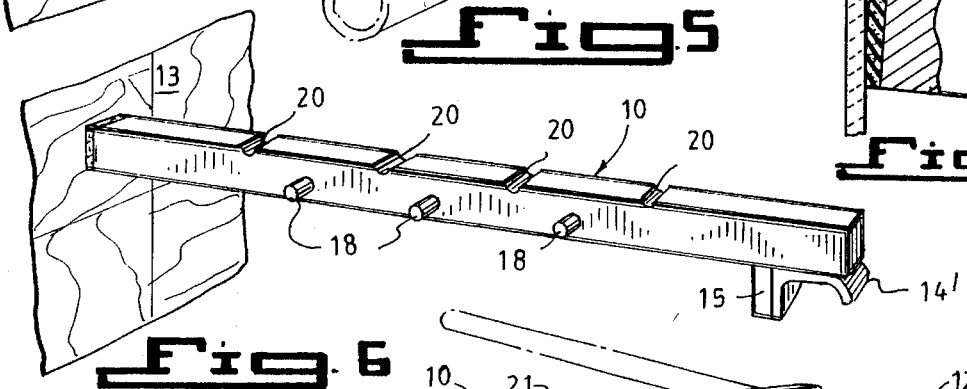
Fig. 6
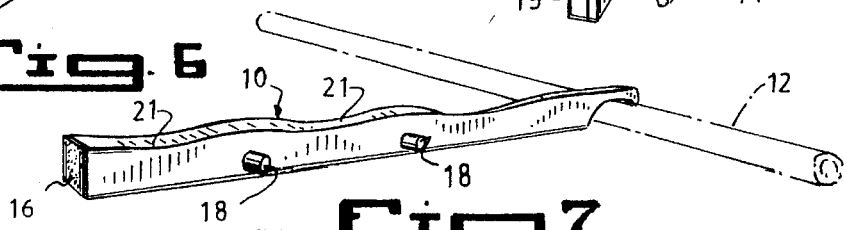
Fig. 7

REMOVABLE BATH ACCESSORY BAR

BACKGROUND OF THE INVENTION

1. Field of the Invention

The present invention relates to a support bar for shower or bath accessories and wet apparel. More particularly, the present invention relates to a removable bath accessory bar for hanging bath accessories traversally across a bathing area between a shower curtain or door support and an opposite wall.

2. Description of the Prior Art

Numerous innovations for hanging bath accessories and drip-drying apparel have been provided in the past. For example, Aldbrycht, U.S. Pat. No. 3,140,557, discloses a movable hanging support means for a soap tray hung on a bathtub curtain support for hand level access to the soap when standing in the tub.

In addition, Levy, U.S. Pat. Nos. 4,123,024 and 4,033,538, disclose support apparatus specifically designed for use in drip drying wet apparel and the like. The device is suspended over and along the top surface of the shower doors and is adjustable to fit all shower doors which vary in width. Finally, Markward, U.S. Pat. No. 2,705,385, relates to a support for a receptacle for bathing accessories and the like, for example a soapdish, which is mounted on the curtain support, and positioned such that it moves with the curtain support.

While apparently generally acceptable for their intended functions, so far as is known, none of the prior art devices afford a readily removable and positionable bath support mechanism which may be horizontally positioned traversally across the bathing area between the shower curtain or door support and the opposite wall of the bathing area to support a variety and multitude of bath and clothing items and/or accessories directly over the bathtub. Further, so far as is known, there is no presently available support which is facially adaptable to fit variously shaped shower curtain or door supports allowing easy ready lateral movement across the bathing area.

SUMMARY OF THE INVENTION

Accordingly, it is an object of the present invention to provide a novel removable bath accessory bar for hanging bath accessories located traversally across and above a bathing area which allows a person to hang bathing accessories and/or dripping apparel.

It is another object of the present invention to provide a bath accessory bar for hanging bath accessories which is economical to manufacture, durable and relatively of simple construction and design.

Another object of the invention is to provide a bath accessory bar for hanging bath accessories which is safely and securely mounted above and traversally across the bathing area and capable of being moved along the shower curtain or door support in a safe manner.

More particularly, it is an object of the present invention to provide a bath accessory bar for hanging bath accessories which is universally adaptable to a variety of bathtub and shower stalls of different dimensions and widths.

Certain of the foregoing and related objects are attained in accordance with the present invention by the provision of a removable bath accessory bar for hanging bath accessories traversally across and above a bathing area between a shower curtain or door support and an opposite wall, which includes an elongated support bar configured and dimensioned to generally span the width of a bathing area when secured in a generally horizontal position which has a first end and an opposite second end. The bar further includes means for hanging bath accessories on the support bar and means for supporting the support bar between the wall of the bathing area and the shower curtain support. The means for supporting includes means for suspending the first end of the support bar on a shower curtain support such that the opposite second end of the support bar may be wedged against the opposite wall of a bathing area.

Preferably, the means for hanging includes a multiplicity of support pegs normally projecting outwardly from the support bar, the support pegs being mounted on and along the support bar in a spaced-apart manner. Advantageously, the support bar is rectangular and has a front face and a rear face from at least one of which the support pegs project. Most desirably, the front face and the rear face of the support bar include a multiplicity of support pegs for hanging bath accessories. The support bar may also have a top face containing a multiplicity of hanger grooves formed thereon.

In a particular preferred embodiment of the present invention, a resilient cushion is attached to the opposite second end of the support bar. Advantageously, the resilient cushion is made from plastic or rubber.

Preferably, the means for suspending the first end of the support bar on a shower support comprises a hook-like hanger mounted on the first end. Most advantageously, the hook-like hanger of the support bar is disposed outwardly of the first end.

In a particular preferred embodiment, the means for suspending the first end of the support bar on a shower support comprises a downwardly projecting flange secured to the support bar adjacent to but spaced from the first end of the support bar. In a further preferred embodiment, the top face of the support bar has an undulating top face which forms a plurality of support wells for hanging bath accessories.

BRIEF DESCRIPTION OF THE DRAWINGS

FIG. 3 is a side elevational view in part section of the bath accessory bar showing the same mounted across the bathtub;

FIG. 3*a* side view in part elevation of the bath accessory bar showing its resilient cushion in non-slip angled position against the bath wall;

FIG. 4 is a fragmentarily-illustrated front, top and side view of an alternative embodiment of the bath accessory bar and bath curtain support on which it is mounted;

FIG. 5 is a front, top and side perspective view of the bath accessory bar displayed between the bath wall and shower curtain support, the latter of which is in phantom view;

FIG. 6 is a front, top and side perspective view of the bath accessory bar for hanging bath accessories having a multiplicity of hanger grooves formed thereon;

FIG. 7 is a rear, top and side perspective view of alternative embodiment of the removable bath accessory bar.

DETAILED DESCRIPTION OF THE PREFERRED EMBODIMENT

Figure 1:
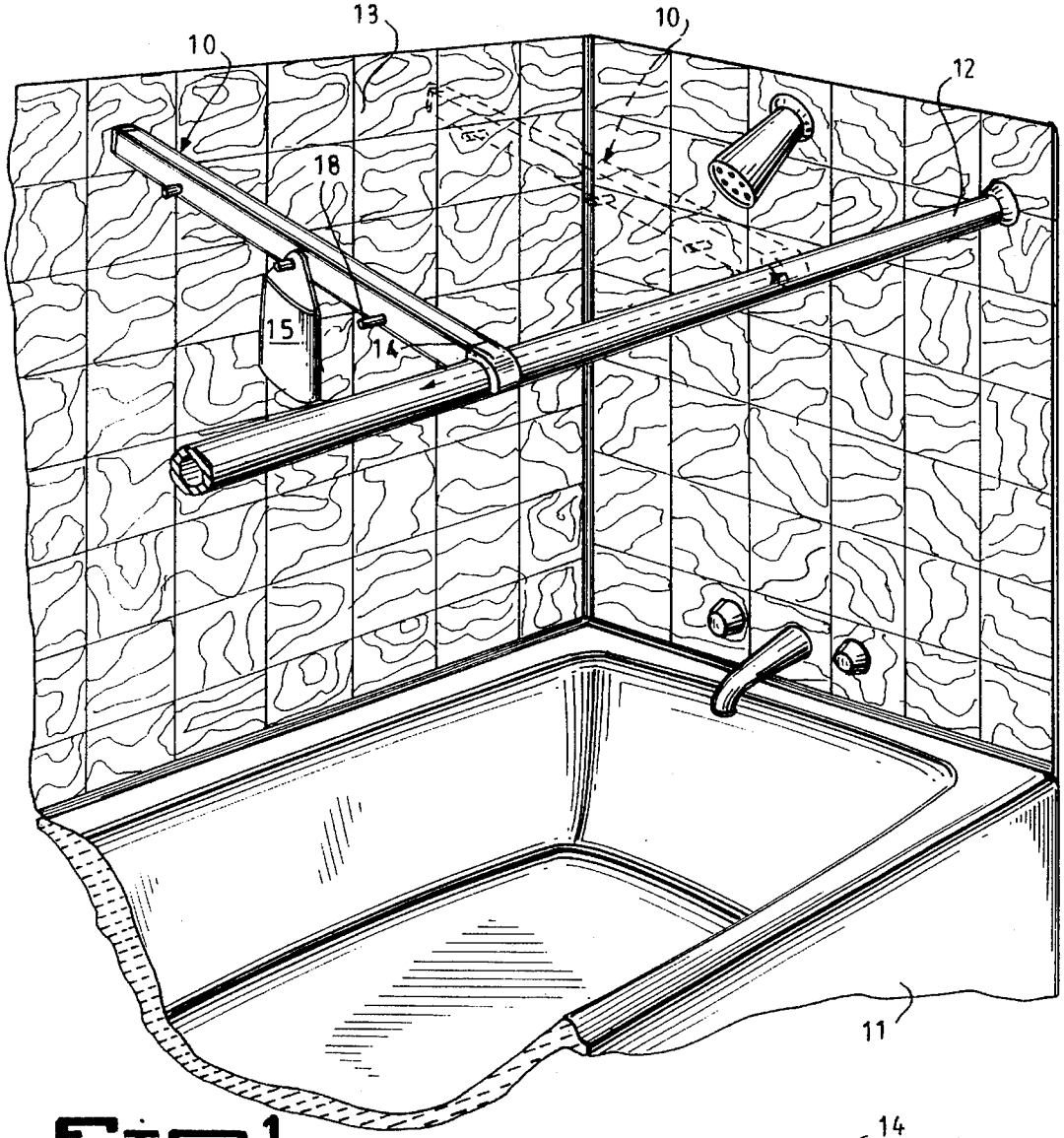
FIG. 1 is a front, top and side isometric view of the bath accessory bar for hanging bath accessories according to the invention located traversally across the bathing area and further showing in phantom view an alternative thereof.

Turning now in detail to the appended drawings, and in particular FIG. 1, therein illustrated is a novel removable bath accessory bar for hanging bath accessories, embodying the present invention, generally designated by reference numeral 10. Bar 10 is configured and dimensioned to span the width of a bathing area, i.e., a bathtub 11 or a shower stall. In particular, in FIG. 1 the removable bath accessory bar 10 is shown disposed traversally across the bath 11 in a generally horizontal position between a shower curtain support or rod 12 and an opposite wall 13. The bar 10 may be conveniently positioned at any point along the length of the tub 11, as shown by the arrow and one alternate position thereof, shown in phantom line.

Figure 2:
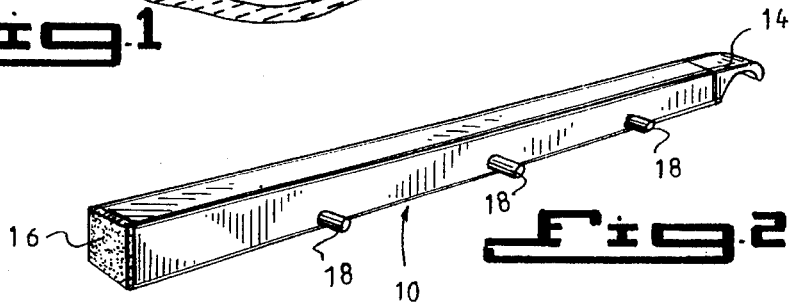
FIG. 2 a rear, top and side isometric view of the bath accessory bar.

As seen more clearly in FIG. 2, bar 10 is preferably rectangular and has a hook-like hanger 14 mounted on one end thereof by which the bath accessory bar 10 may be mounted atop the shower curtain support 12. Bar 10 preferably includes a rubber or plastic cushion 16 at its opposite end by which the bar 10 may be wedged against wall 13 when mounted, as more fully described hereinafter. Bar 10 is also provided with a multiplicity of spaced apart support pegs 18 normally projecting outwardly from the front and/or rear face of bar 10 used for hanging various bathing accessories 15 or wet clothing articles thereon (See FIG. 1).

FIGS. 3 and 3*a* illustrate the installation of the removable bath accessory bar 10 over and across the width of the bath tub 11. Initially, bar is lowered from above curtain rod 12 (shown in phantom line in FIG. 3) such that the hook-like hanger 14 or bar 10 is placed on the curtain rod 12. The opposite end of bar 10 is pivoted downwardly (initial position depicted in phantom line) using hanger 14 and curtain rod 12 as a pivot joint until its cushioned end 16 is wedged against wall 13 (as indicated by the solid line position of the bar 10 in FIG. 3 and FIG. 3*a*). As can be appreciated, it is necessary for the bar 10 to have a sufficient effective length slightly longer than the distance between wall 13 and curtain rod 12 so that its cushioned end 16 is wedged against wall 13 and so that bar 10 is suspended across the tub 11 either horizontally or at a slant in a slightly downwardly angled position (See FIG. 3). This slanted position ensures that the bar can accommodate a range of bathtub widths. For narrower bathtubs or shower stalls, the bar will be at a greater slant or angle.

FIGS. 4 and 5 illustrate alternative embodiments for the hook-like hanger 14. In FIG. 4, the hook-like hanger 14 is mounted beneath the end of the bar 10 buttressed against a depending flange 15, allowing the removable bath accessory bar 10 to rest atop rather than adjacent to the shower curtain support 12. In FIG. 5, a raised hook like hanger 14 is disposed outwardly of the end of bar 10 thereby positioning the bar 10 to slideably hang from the shower curtain support 12.

As shown in FIG. 6, the top face of the bar 10 may be provided with multiplicity of spaced-apart hanger grooves 20 for hanging various accessories via conventional hangers or the like. Alternatively, as shown in FIG. 7, the bar 10 can also have an undulating top face which form a plurality of support wells 21 instead of grooves 20 for the hangers.

Various modifications may be made as will be apparent to those skilled in the art. For example, while bar 10 is preferably made from wood, plastic and/or metal, it may be made from a hardened yet resilient rubber or plastic material thereby eliminating the need for a cushion 16. Instead of fixed support pegs 18, removable pegs could be provided capable of being pushed through the one face of the bar 10 to project from the opposite face allowing accessories to hang from either side of the bar 10. Advantageously, the bar 10 could be constructed of two or more telescopically-disposed members to allow the same to span different sized bathtubs 11. The hook-like hangers can also be modified for fitting variously shaped and/or sized shower curtain rods or supports 12. It should also be noted that although the bar is shown used in connection with a bathtub and a shower curtain rod, it could be modified for use with other bathtub or bath stall doors or other fixtures.

Accordingly, while several embodiments of the present invention have been illustrated in the appended drawings, it is to be understood that various modifications may be made as will be apparent to those skilled in the art.

What is claimed is:

1. A removable bath accessory bar for hanging bath accessories traversally across and above a bathing area between a shower curtain support rod or door support and an opposite wall, comprising:

an elongated support bar of rectangular cross section with vertical side walls and top and bottom horizontal walls configured and dimensioned to generally span the width of said bathing area when secured in a generally horizontal position, the length of support bar being slightly longer that the distance between said opposite wall and said curtain support rod;

said support bar having a first end and an opposite second end;

means for hanging bath accessories on said support bar comprising spaced pegs extending from the vertical sides of said support bar and spaced hanger grooves on the top surface of said support bar; and said support bar including means for supporting said support bar between the wall of the bathing area and said shower curtain rod comprising a hook shaped member mounted on the bottom horizontal wall of said bar adjacent the first end of said support bar with a flange extending down from said bottom horizontal wall of said support bar to buttress said hook shaped member, said hook shaped member having an end wall flush against said flange and a top wall flush against said bottom horizontal wall and a curved inner surface to engage said curtain rod with a lip curving downwardly adjacent the first end of said support rod, and cushion means mounted on the second end of said support bar, such that said opposite second end of said support bar may be wedged against the opposite wall of said bathing area when said hook shaped member is placed on said curtain rod.

* * * * *